US011859824B2

(12) United States Patent
Ganiger et al.

(10) Patent No.: US 11,859,824 B2
(45) Date of Patent: Jan. 2, 2024

(54) COMBUSTOR WITH A DILUTION HOLE STRUCTURE

(71) Applicant: General Electric Company, Schenectady, NY (US)

(72) Inventors: Ravindra Shankar Ganiger, Bengaluru (IN); Hiranya Nath, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/931,697

(22) Filed: Sep. 13, 2022

(65) Prior Publication Data

US 2023/0366555 A1 Nov. 16, 2023

(30) Foreign Application Priority Data

May 13, 2022 (IN) ..... 202211027642

(51) Int. Cl.
*F23R 3/60* (2006.01)
*F23R 3/00* (2006.01)
*F23R 3/06* (2006.01)

(52) U.S. Cl.
CPC ..... *F23R 3/60* (2013.01); *F23R 3/002* (2013.01); *F23R 3/06* (2013.01); *F23R 2900/00017* (2013.01); *F23R 2900/03044* (2013.01)

(58) Field of Classification Search
CPC ... F23M 5/04; F23R 3/002; F23R 3/06; F23R 3/50; F23R 3/60; F23R 2900/00017; F23R 2900/03044
See application file for complete search history.

(56) References Cited

U.S. PATENT DOCUMENTS

| | | | | |
|---|---|---|---|---|
| 3,737,152 | A | 6/1973 | Wilson | |
| 3,793,827 | A | 2/1974 | Ekstedt | |
| 3,811,276 | A | 5/1974 | Caruel et al. | |
| 3,845,620 | A | 11/1974 | Kenworthy | |
| 4,004,056 | A | 1/1977 | Carroll | |
| 4,380,896 | A | 4/1983 | Wiebe | |
| 4,414,816 | A * | 11/1983 | Craig | F23R 3/002 60/757 |
| 6,155,056 | A | 12/2000 | Sampath et al. | |
| 6,427,446 | B1 | 8/2002 | Kraft et al. | |
| 7,017,334 | B2 | 3/2006 | Mayer et al. | |
| 7,152,411 | B2 | 12/2006 | McCaffrey et al. | |

(Continued)

FOREIGN PATENT DOCUMENTS

| | | |
|---|---|---|
| EP | 0905353 B1 | 1/2003 |
| EP | 2995863 B1 | 5/2018 |

(Continued)

*Primary Examiner* — Scott J Walthour
(74) *Attorney, Agent, or Firm* — Venable LLP; Michele V. Frank

(57) ABSTRACT

A combustor including a skeleton structure. The combustor further includes at least one liner operably coupled to the skeleton structure to at least partially define a combustion chamber, and a plurality of first planks mounted to a first side of the at least one liner and a plurality of second planks mounted to a second side of the at least one liner. The combustor also includes at least one dilution hole structure provided with a portion of the skeleton structure, and including at least one dilution hole configured to allow fluid to pass therethrough into the combustion chamber.

20 Claims, 11 Drawing Sheets

(56) References Cited

U.S. PATENT DOCUMENTS

| | | | |
|---|---|---|---|
| 7,219,498 | B2 | 5/2007 | Hadder |
| 7,237,389 | B2 | 7/2007 | Ryan et al. |
| 7,338,244 | B2 | 3/2008 | Glessner et al. |
| 7,389,643 | B2 | 6/2008 | Simons et al. |
| 8,033,114 | B2 | 10/2011 | Hernandez et al. |
| 8,316,541 | B2 | 11/2012 | Patel et al. |
| 8,727,714 | B2 | 5/2014 | Snider et al. |
| 9,080,770 | B2 | 7/2015 | Dudebout et al. |
| 9,127,565 | B2 | 9/2015 | Keller et al. |
| 9,328,665 | B2 | 5/2016 | Doerr et al. |
| 9,341,377 | B2 | 5/2016 | Kramer |
| 9,360,217 | B2 | 6/2016 | DiCintio et al. |
| 9,612,017 | B2 | 4/2017 | Vetters |
| 9,651,258 | B2 | 5/2017 | Graves et al. |
| 9,709,280 | B2 | 7/2017 | Preston, III |
| 9,829,199 | B2 | 11/2017 | Mayer |
| 9,958,159 | B2 | 5/2018 | Smallwood et al. |
| 10,107,128 | B2 | 10/2018 | Romanov et al. |
| 10,378,767 | B2 | 8/2019 | Maurer et al. |
| 10,386,066 | B2 | 8/2019 | Cunha et al. |
| 10,422,532 | B2 | 9/2019 | Sadil et al. |
| 10,451,279 | B2 | 10/2019 | Staufer |
| 10,473,331 | B2 | 11/2019 | Quach et al. |
| 10,563,865 | B2 | 2/2020 | Chang |
| 10,598,382 | B2 | 3/2020 | Tu et al. |
| 10,648,666 | B2 | 5/2020 | Bouldin et al. |
| 10,767,863 | B2 | 9/2020 | Freeman et al. |
| 10,801,730 | B2 | 10/2020 | Kramer |
| 10,801,731 | B2 | 10/2020 | Dillard |
| 10,808,930 | B2 | 10/2020 | Schlichting |
| 10,969,103 | B2 | 4/2021 | Chang et al. |
| 11,015,812 | B2 | 5/2021 | Petty, Sr. et al. |
| 2010/0236250 | A1 | 9/2010 | Headland et al. |
| 2015/0260399 | A1 | 9/2015 | Low |
| 2016/0186998 | A1* | 6/2016 | Kostka, Jr. ..... F23R 3/045 415/115 |
| 2016/0208704 | A1* | 7/2016 | Bouldin ..... F02C 7/18 |
| 2016/0245518 | A1 | 8/2016 | Drake |
| 2018/0292090 | A1 | 10/2018 | Dyer et al. |
| 2018/0306113 | A1 | 10/2018 | Morton et al. |
| 2020/0088410 | A1* | 3/2020 | Dillard ..... F23R 3/007 |
| 2020/0116360 | A1 | 4/2020 | White et al. |
| 2020/0348023 | A1 | 11/2020 | Paauwe et al. |
| 2021/0018178 | A1 | 1/2021 | Sze |
| 2021/0102705 | A1 | 4/2021 | Kramer |
| 2021/0325043 | A1 | 10/2021 | Freeman et al. |

FOREIGN PATENT DOCUMENTS

| | | | |
|---|---|---|---|
| EP | 2868973 | B1 | 12/2018 |
| EP | 3770500 | A1 | 1/2021 |
| EP | 3321586 | B1 | 6/2021 |
| GB | 2432902 | B | 1/2011 |

* cited by examiner

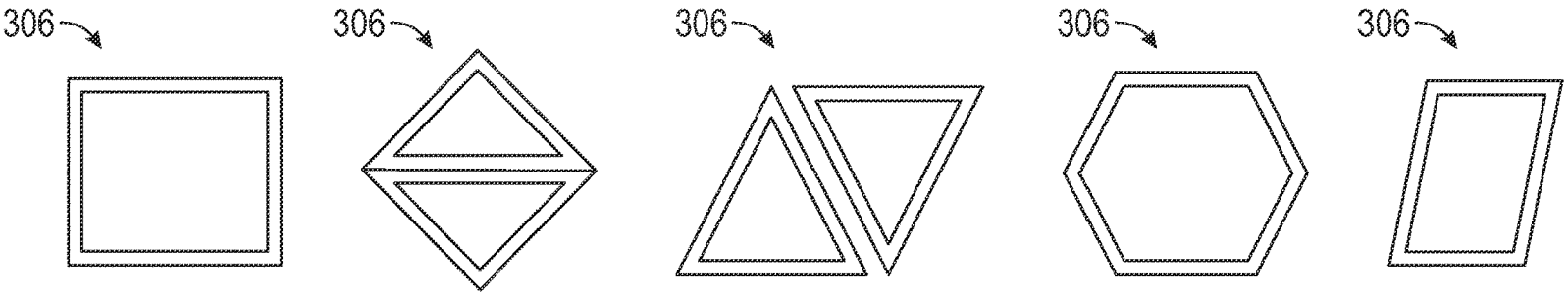
FIG. 10A
FIG. 10B
FIG. 10C
FIG. 10D
FIG. 10E
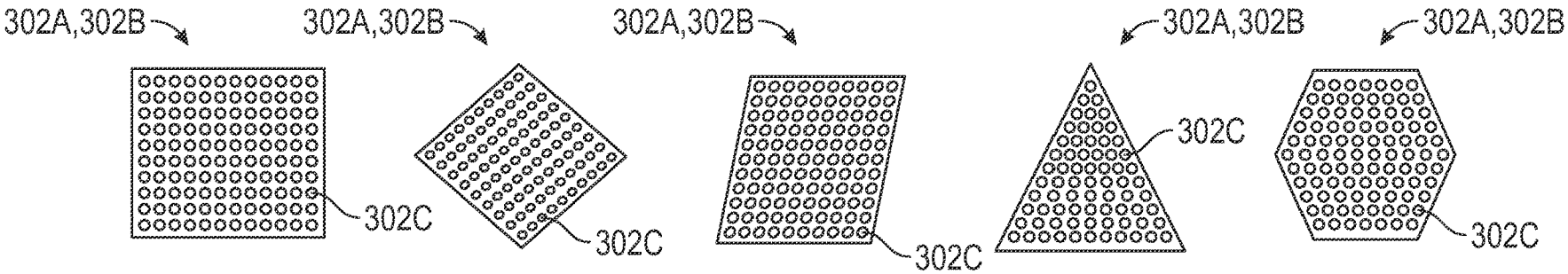
FIG. 11A
FIG. 11B
FIG. 11C
FIG. 11D
FIG. 11E

COMBUSTOR WITH A DILUTION HOLE STRUCTURE

CROSS REFERENCE TO RELATED APPLICATIONS

The present application claims the benefit of Indian Patent Application No. 202211027642, filed on May 13, 2022, which is hereby incorporated by reference herein in its entirety.

TECHNICAL FIELD

The present disclosure relates generally to combustors and, in particular, to a combustor having a dilution hole structure having a plurality of dilution holes.

BACKGROUND

A gas turbine engine generally includes a fan and a core arranged in flow communication with one another, with the core disposed downstream of the fan in a direction of flow through the gas turbine engine. The core of the gas turbine engine generally includes, in serial flow order, a compressor section, a combustion section, a turbine section, and an exhaust section. With multi-shaft gas turbine engines, the compressor section can include a high pressure compressor (HPC) disposed downstream of a low pressure compressor (LPC), and the turbine section can similarly include a low pressure turbine (LPT) disposed downstream of a high pressure turbine (HPT). With such a configuration, the HPC is coupled with the HPT via a high pressure shaft (HPS), and the LPC is coupled with the LPT via a low pressure shaft (LPS). In operation, at least a portion of air over the fan is provided to an inlet of the core. Such a portion of the air is progressively compressed by the LPC and, then, by the HPC until the compressed air reaches the combustion section. Fuel is mixed with the compressed air and burned within the combustion section to produce combustion gases. The combustion gases are routed from the combustion section through the HPT and, then, through the LPT. The flow of combustion gases through the turbine section drives the HPT and the LPT, each of which in turn drives a respective one of the HPC and the LPC via the HPS and the LPS. The combustion gases are then routed through the exhaust section, e.g., to atmosphere. The LPT drives the LPS, which drives the LPC. In addition to driving the LPC, the LPS can drive the fan through a power gearbox, which allows the fan to be rotated at fewer revolutions per unit of time than the rotational speed of the LPS, for greater efficiency.

The fuel that mixed with the compressed air and burned within the combustion section is delivered through a fuel nozzle.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

FIGS. 10A to 10E show various geometrical configurations of structural elements of the skeleton mesh structure shown in FIGS. 3, 4, and 6, according to various embodiments of the present disclosure.

FIGS. 11A to 11E show various geometrical configurations of planks of the plurality of inner planks and the plurality of outer planks, according to various embodiments of the present disclosure.

DETAILED DESCRIPTION

Figure 1:
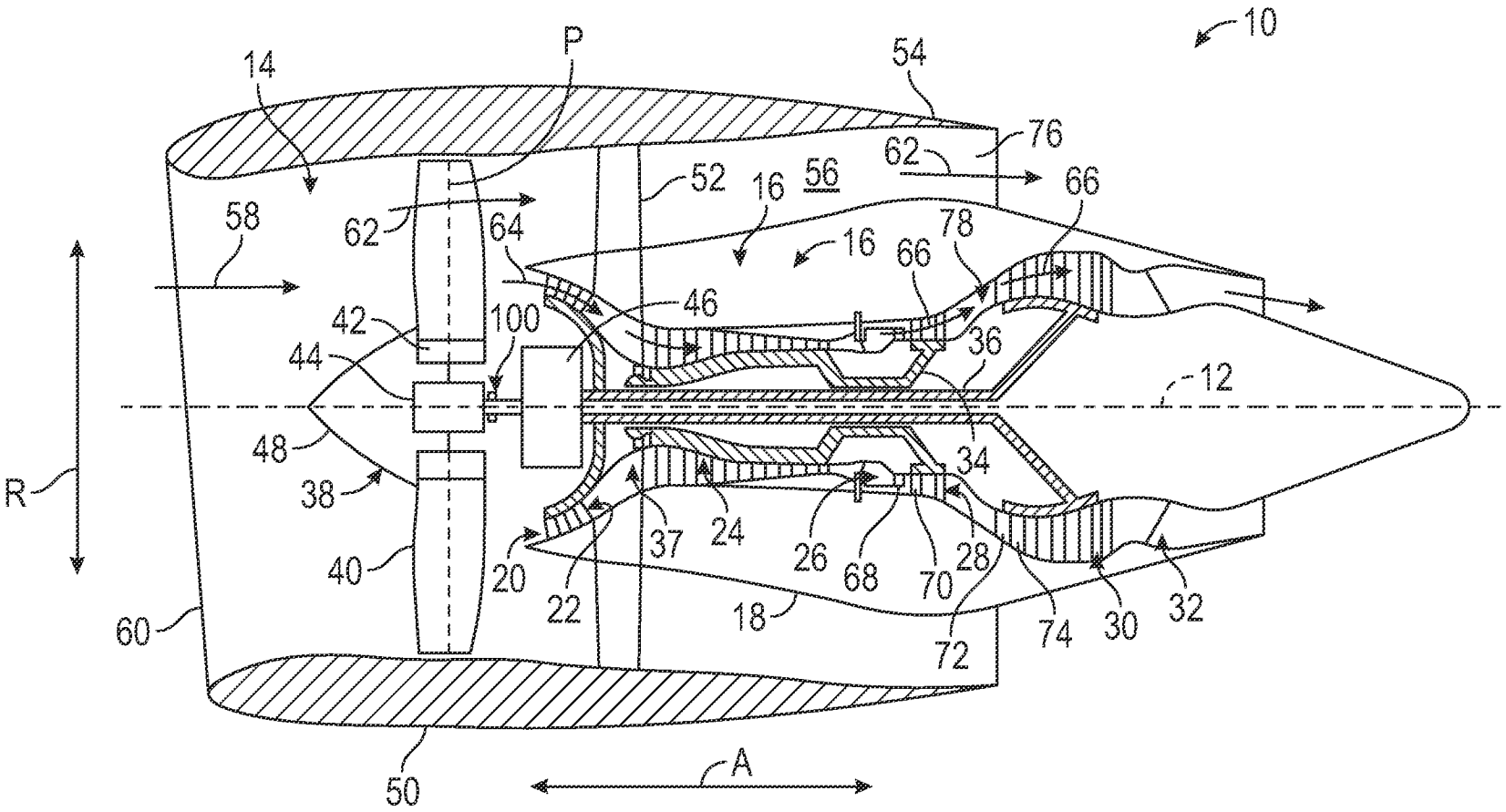
FIG. 1 is a schematic cross-sectional diagram of a turbine engine, according to an embodiment of the present disclosure.

Additional features, advantages, and embodiments of the present disclosure are set forth or apparent from a consideration of the following detailed description, drawings, and claims. Moreover, both the foregoing summary of the present disclosure and the following detailed description are exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the spirit and the scope of the present disclosure.

In the following specification and the claims, reference may be made to a number of "optional" or "optionally" elements meaning that the subsequently described event or circumstance may occur or may not occur, and that the description includes instances in which the event occurs and instances in which the event does not occur.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to a flow in a pathway. For example, with respect to a fluid flow, "upstream" refers to the direction from which the fluid flows, and "downstream" refers to the direction to which the fluid flows. The term "fluid" may be a gas or a liquid. The term "fluid communication" means that a fluid is capable of making the connection between the areas specified.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. For example, the approximating language may refer to being within a 1, 2, 4, 5, 10, 15, or 20 percent margin in either individual values, range(s) of values and/or endpoints defining range(s) of values. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the turbine engine or the combustor. Moreover, the terms "radial" and "radially" refer to directions and orientations that extend substantially perpendicular to the centerline of the turbine engine or the fuel-air mixer assembly. In addition, as used herein, the terms "circumferential" and "circumferentially" refer to directions and orientations that extend arcuately about the centerline of the turbine engine or the fuel-air mixer assembly.

As will be further described in detail in the following paragraphs, a combustor is provided with improved liner durability under a harsh heat and stress environment. The combustor includes a skeleton mesh structure (also referred to as a hanger or a truss) on which are coupled to an inner liner and an outer liner. The skeleton mesh structure acts as a supporting structure for the inner liner and the outer liner as whole. In an embodiment, the skeleton mesh structure can be made of metal. The skeleton mesh structure, together with the inner liner and the outer liner, define the combustion chamber. The inner liner and the outer liner include a plurality of inner planks. The plurality inner planks cover at least the inner side of the skeleton mesh structure. In an embodiment, the plurality of inner planks can be made of a ceramic material, a Ceramic Matrix Composite (CMC) material, or a metal coated with CMC or thermal barrier coating (TBC). In an embodiment, the plurality inner planks are exposed to hot flames. A connection interface of the plurality of inner planks to the skeleton mesh structure can be configured to be thermally expansion tolerant. Furthermore, the plurality of inner planks coupled to the skeleton mesh structure interface can be configured to improve performance in terms of reducing air leakage to a very minimal value or substantially eliminating the air leakage, so that the interface does not impact aerodynamics for NOR/thermal field and film cooling. Dilution holes can be provided on cross-bars of the skeleton mesh structure or on separate dilution hole planks attached to the skeleton mesh structure. The holes can have various patterns and shapes. The parametric relations of the dilution hole, the cooling holes and the plank area are defined using ratios. Dilution hole plank connections fasteners include, but are not limited to, bolts, pins, clips, etc. Other attachment methods include using brazing, welding, additive, spring clips, pistons seals, W-seals, and gang channel sliding, etc. A W-seal is a W-shaped seal that can be provided to restrict air leakage. This configuration can increase combustor durability significantly, in addition to providing increased time on wing (TOW) and fuel burn benefit due to weight reduction. This further provides a light-weight design with greater than twenty percent weight savings, overall manufacturing cost savings and relatively easier maintenance and repair.

FIG. 1 is a schematic cross-sectional diagram of a turbine engine 10, according to an embodiment of the present disclosure. More particularly, for the embodiment shown in FIG. 1, the turbine engine 10 is a high-bypass turbine engine. As shown in FIG. 1, the turbine engine 10 defines an axial direction A (extending parallel to a longitudinal centerline 12 provided for reference) and a radial direction R, generally perpendicular to the axial direction A. The turbine engine 10 includes a fan section 14 and a core turbine engine 16 disposed downstream from the fan section 14. The term "downstream" is used herein with reference to air flow direction 58.

The core turbine engine 16 depicted generally includes an outer casing 18 that is substantially tubular and that defines an annular inlet 20. The outer casing 18 encases, in serial flow relationship, a compressor section including a booster or a low pressure compressor (LPC) 22 and a high pressure compressor (HPC) 24, a combustion section 26, a turbine section including a high pressure turbine (HPT) 28 and a low pressure turbine (LPT) 30, and a jet exhaust nozzle section 32. A high pressure shaft (HPS) 34 drivingly connects the HPT 28 to the HPC 24. A low pressure shaft (LPS) 36 drivingly connects the LPT 30 to the LPC 22. The compressor section, the combustion section 26, the turbine section, and the jet exhaust nozzle section 32 together define a core air flow path 37.

For the embodiment depicted, the fan section 14 includes a fan 38 with a variable pitch having a plurality of fan blades 40 coupled to a disk 42 in a spaced apart manner. As depicted, the fan blades 40 extend outwardly from the disk 42, generally along the radial direction R. Each fan blade 40 is rotatable relative to the disk 42 about a pitch axis P by virtue of the fan blades 40 being operatively coupled to a suitable actuation member 44 that is configured to collectively vary the pitch of the fan blades 40 in unison. The fan blades 40, the disk 42, and the actuation member 44 are together rotatable about the longitudinal centerline 12 (longitudinal axis) by the LPS 36 across a power gear box 46. The power gear box 46 includes a plurality of gears for adjusting or controlling the rotational speed of the fan 38 relative to the LPS 36 to a more efficient rotational fan speed.

The disk 42 is covered by a rotatable front hub 48 aerodynamically contoured to promote an air flow through the plurality of fan blades 40. Additionally, the fan section 14 includes an annular fan casing or a nacelle 50 that circumferentially surrounds the fan 38 and/or at least a portion of the core turbine engine 16. The nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass air flow passage 56 therebetween.

During operation of the turbine engine 10, a volume of air flow 58 enters the turbine engine 10 in air flow direction 58 through an associated inlet 60 of the nacelle 50 and/or the fan section 14. As the volume of air passes across the fan blades 40, a first portion of the air, as indicated by arrows 62, is directed or routed into the bypass air flow passage 56 and a second portion of the air, as indicated by arrow 64, is directed or routed into the core air flow path 37, or, more specifically, into the LPC 22. The ratio between the first portion of air indicated by arrows 62 and the second portion of air indicated by arrows 64 is commonly known as a bypass ratio. The pressure of the second portion of air, indicated by arrows 64, is then increased as it is routed through the HPC 24 and into the combustion section 26, where it is mixed with fuel and burned to provide combustion gases 66.

The combustion gases 66 are routed through the HPT 28 where a portion of thermal energy and/or kinetic energy from the combustion gases 66 is extracted via sequential stages of HPT stator vanes 68 that are coupled to the outer casing 18 and HPT rotor blades 70 that are coupled to the HPS 34, thus, causing the HPS 34 to rotate, thereby supporting operation of the HPC 24. The combustion gases 66 are then routed through the LPT 30 where a second portion of thermal and kinetic energy is extracted from the combustion gases 66 via sequential stages of LPT stator vanes 72 that are coupled to the outer casing 18 and LPT rotor blades 74 that are coupled to the LPS 36, thus, causing the LPS 36 to rotate, thereby supporting operation of the LPC 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass air flow passage 56 before it is exhausted from a fan nozzle exhaust section 76 of the turbine engine 10, also providing propulsive thrust. The HPT 28, the LPT 30, and the jet exhaust nozzle section 32 at least partially define a hot gas path 78 for routing the combustion gases 66 through the core turbine engine 16.

The turbine engine 10 depicted in FIG. 1 is, however, by way of example only. In other exemplary embodiments, the turbine engine 10 may have any other suitable configuration. In still other exemplary embodiments, aspects of the present disclosure may be incorporated into any other suitable gas turbine engine. For example, in other exemplary embodiments, aspects of the present disclosure may be incorporated into, e.g., a turboshaft engine, a turboprop engine, a turbocore engine, a turbojet engine, etc.

Figure 2:
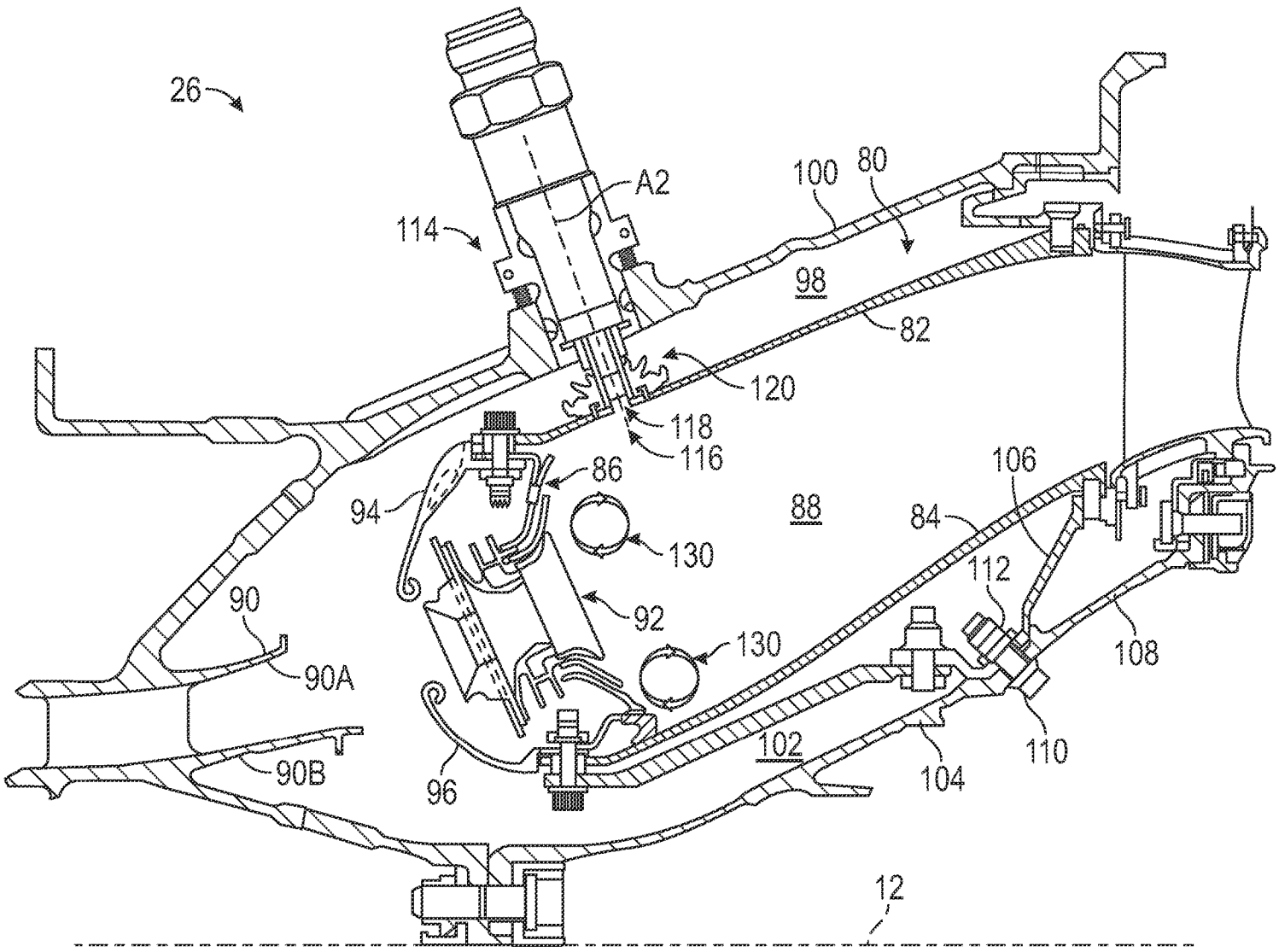
FIG. 2 is a schematic cross-sectional view of a combustion section of the turbine engine of FIG. 1, according to an embodiment of the present disclosure.

FIG. 2 is a schematic, cross-sectional view of the combustion section 26 of the turbine engine 10 of FIG. 1, according to an embodiment of the present disclosure. The combustion section 26 generally includes a combustor 80 that generates the combustion gases discharged into the turbine section, or, more particularly, into the HPT 28. The combustor 80 includes an outer liner 82, an inner liner 84, and a dome 86. The outer liner 82, the inner liner 84, and the dome 86 together define a combustion chamber 88. In addition, a diffuser 90 is positioned upstream of the combustion chamber 88. The diffuser 90 has an outer diffuser wall 90A and an inner diffuser wall 90B. The inner diffuser wall 90B is closer to a longitudinal centerline 12. The diffuser 90 receives an air flow from the compressor section and provides a flow of compressed air to the combustor 80. In an embodiment, the diffuser 90 provides the flow of compressed air to a single circumferential row of fuel/air mixers 92. In an embodiment, the dome 86 of the combustor 80 is configured as a single annular dome, and the circumferential row of fuel/air mixers 92 are provided within openings formed in the dome 86 (air feeding dome or combustor dome). However, in other embodiments, a multiple annular dome can also be used. In general, other types of combustors can also be used.

In an embodiment, the diffuser 90 can be used to slow the high speed, highly compressed air from a compressor (not shown) to a velocity optimal for the combustor 80. Furthermore, the diffuser 90 can also be configured to limit the flow distortion as much as possible by avoiding flow effects like boundary layer separation. Similar to most other gas turbine engine components, the diffuser 90 is generally designed to be as light as possible to reduce weight of the overall engine.

A fuel nozzle (not shown) provides fuel to fuel/air mixers 92 depending upon a desired performance of the combustor 80 at various engine operating states. In the embodiment shown in FIG. 2, an outer cowl 94 (e.g., an annular cowl) and an inner cowl 96 (e.g., an annular cowl) are located upstream of the combustion chamber 88 so as to direct air flow into fuel/air mixers 92. The outer cowl 94 and the inner cowl 96 may also direct a portion of the flow of air from the diffuser 90 to an outer passage 98 defined between the outer liner 82 and an outer casing 100, and an inner passage 102 defined between the inner liner 84 and an inner casing 104. In addition, an inner support cone 106 is further shown as being connected to a nozzle support 108 using a plurality of bolts 110 and nuts 112. Other combustion sections, however, may include any other suitable structural configurations.

The combustor 80 also has an igniter 114. The igniter 114 is provided to ignite the fuel/air mixture supplied to combustion chamber 88 of the combustor 80. The igniter 114 is attached to the outer casing 100 of the combustor 80 in a substantially fixed manner. Additionally, the igniter 114 extends generally along an axial direction A2, defining a distal end 116 that is positioned proximate to an opening in a combustor member of the combustion chamber 88. The distal end 116 is positioned proximate to an opening 118 within the outer liner 82 of the combustor 80 to the combustion chamber 88.

In an embodiment, the dome 86 of the combustor 80, together with the outer liner 82, the inner liner 84, and fuel/air mixers 92, forms the combustion chamber and define a swirling flow 130. The air flows through the fuel/air mixers 92 as the air enters the combustion chamber 88. The role of the dome 86 and the fuel/air mixers 92 is to generate turbulence in the air flow to rapidly mix the air with the fuel to create a fuel-air mixture. The swirler (also called a mixer) establishes a local low pressure zone that forces some of the combustion products to recirculate, as illustrated in FIG. 2, creating needed high turbulence.

Figure 3:
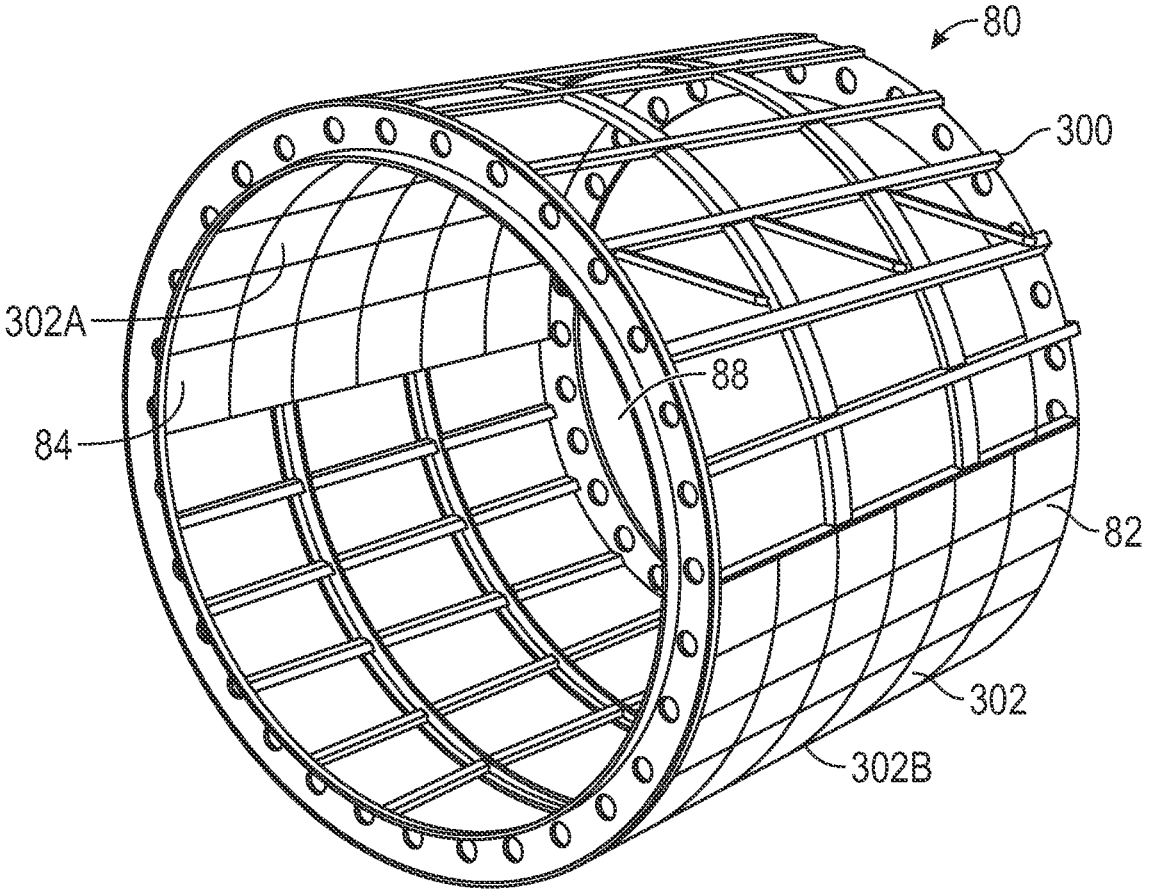
FIG. 3 is a schematic perspective view of a section of a combustor, according to an embodiment of the present disclosure.

FIG. 3 is a schematic perspective view of a section of the combustor 80, according to an embodiment of the present disclosure. The combustor 80 is shown having a cylindrical configuration. The combustor 80 comprises a skeleton mesh structure 300 (also referred to as a hanger or a truss) on which are mounted the inner liner 84 and the outer liner 82. The skeleton mesh structure 300 acts as a supporting structure for the inner liner 84 and the outer liner 82 as whole. In an embodiment, the skeleton mesh structure 300 is made of metal. The skeleton mesh structure 300, together with the inner liner 84 and the outer liner 82, define the combustion chamber 88. The inner liner 84 and the outer liner 82 include a plurality of planks 302. The plurality of planks 302 include a plurality of inner planks 302A and, optionally, a plurality of outer planks 302B. The plurality of inner planks 302A are mounted to and cover the inner side of the skeleton mesh structure 300, and the outer planks 302B are mounted to and cover the outer side of the skeleton mesh structure 300. The plurality of inner planks 302A are exposed to hot flames within the combustion chamber 88. In an embodiment, the plurality of inner planks 302A are made of ceramic or are made of metal coated with a ceramic coating or thermal barrier coating (TBC) to enhance resistance to relatively high temperatures. In an embodiment, the plurality of inner planks 302A can be made of a ceramic material, a Ceramic Matrix Composite (CMC) material, or a metal coated with CMC or TBC. In an embodiment, the outer planks 302B can be made of a metal or a Ceramic Matrix Composite (CMC). In an embodiment, the outer planks 302B are thinner than the plurality of inner planks 302A.

The skeleton mesh structure 300, together with the plurality of inner planks 302A and the plurality of outer planks 302B, can improve durability due to hoop stress reduction or elimination while providing a lightweight liner configuration for the combustor 80. For example, the present configuration provides at least a twenty percent weight reduction as compared to conventional combustors. Furthermore, the present configuration provides the additional benefit of being modular or segmented and, thus, relatively easy to repair or to maintain. Indeed, if one or more planks in the plurality of inner planks 302A or the plurality of outer planks 302B is damaged, only the damaged one or more planks is replaced and, not the entire inner liner 84 or the entire outer liner 82. Furthermore, the present configuration lends itself to be relatively easy to inspect and to repair. All these benefits result in overall cost savings.

Figure 4:
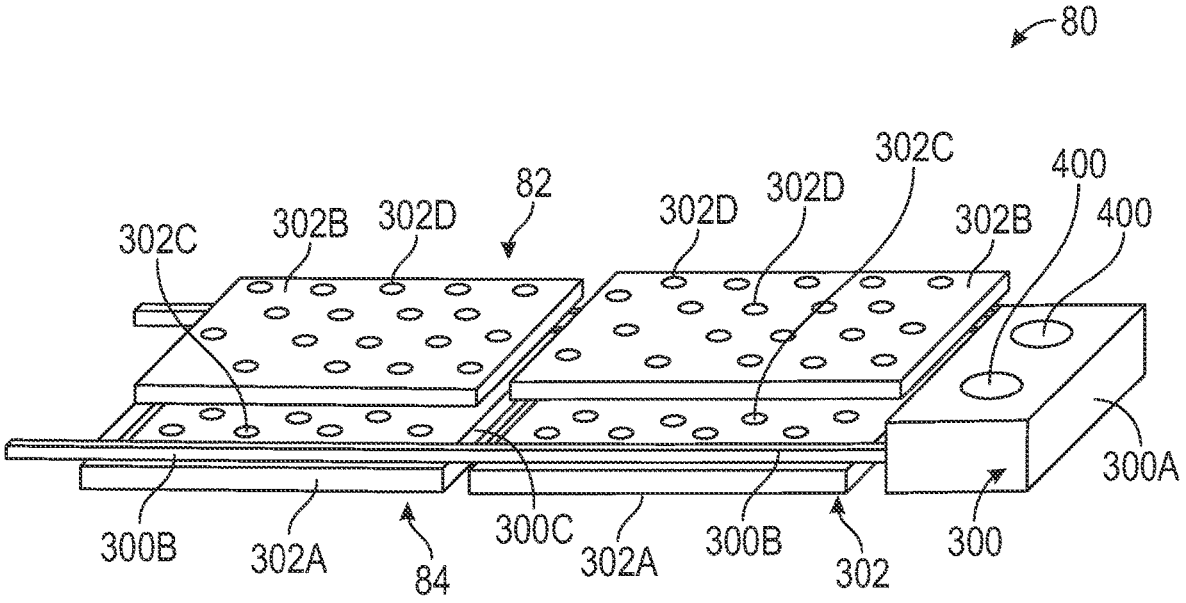
FIG. 4 is a schematic perspective view of a section of an inner liner and an outer liner of the combustor, according to an embodiment of the present disclosure.

FIG. 4 is a schematic perspective view of a section of the inner liner 84 and the outer liner 82 of the combustor 80, according to an embodiment of the present disclosure. As shown in FIG. 4, the plurality of planks 302, which include the plurality of inner planks 302A and the plurality of outer planks 302B, are mounted to the skeleton mesh structure 300. The plurality of inner planks 302A include a plurality of holes 302C. The plurality of outer planks 302B include a plurality of holes 302D. As shown in FIG. 4, the plurality of inner planks 302A are mounted on one side of the skeleton mesh structure 300. The plurality of holes 302C are distributed along a surface of the plurality of inner planks 302A. The plurality of holes 302D are distributed along a surface of the plurality of outer planks 302B.

A plurality of dilution holes 400 are provided in the skeleton mesh structure 300, the plurality of dilution holes 400 are configured to allow air to pass therethrough into the combustion chamber 88 to further mix with the fuel-air mixture. The skeleton mesh structure 300 includes one or more crossbars 300A, a plurality of longitudinal bars 300B, and a plurality of transverse bars 300C. The plurality of transverse bars 300C and the one or more crossbars 300A are substantially perpendicular to the plurality of longitudinal bars 300B. The plurality of inner planks 302A and the plurality of outer planks 302B are operably coupled or mounted to the plurality of longitudinal bars 300B and the plurality of transverse bars 300C. The plurality of dilution holes 400 can be provided on the one or more crossbars 300A of the skeleton mesh structure 300. The one or more crossbars 300A having the plurality of dilution holes 400 is referred generally as a dilution hole structure. In addition, air impinging on the plurality of inner planks 302A can further enter through the plurality of holes 302C in the plurality of inner planks 302A to further cool down the plurality of inner planks 302A. In this exemplary illustration the plurality of dilution holes 400 are within the skeleton mesh structure itself.

Figure 5A:
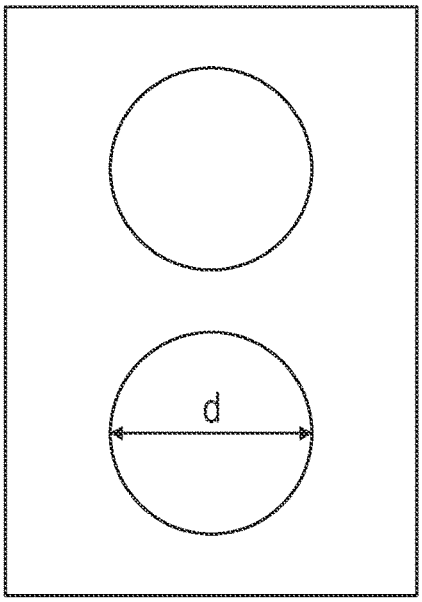
FIG. 5A is a schematic top view of one or more crossbars of a skeleton mesh structure showing a plurality of dilution holes, according to an embodiment of the present disclosure.
Figure 5B:
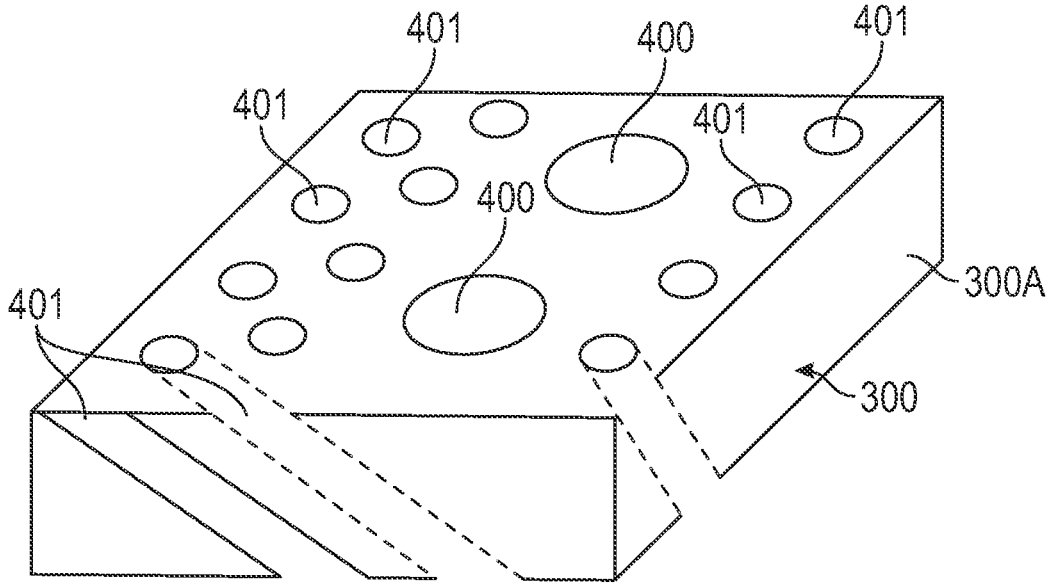
FIG. 5B is a schematic perspective view of the one or more crossbar of the skeleton mesh structure showing the plurality of dilution holes and a plurality of cooling holes, according to an embodiment of the present disclosure.

FIG. 5A is a schematic top view of the one or more crossbar 300A of the skeleton mesh structure 300 showing the plurality of dilution holes 400, according to an embodiment of the present disclosure. FIG. 5B is a schematic perspective view of the one or more crossbar 300A of the skeleton mesh structure 300 showing the plurality of dilution holes 400 and a plurality of cooling holes 401, according to another embodiment of the present disclosure. Although the holes 400 and 401 are shown to be cylindrical and having a circular cross section, the holes 400, 401 can also have an elliptical cross section or a polygonal cross section (e.g., rectangular, hexagonal, etc.). The total area A1 of the plurality of crossbars 300A in the combustor 80 is $\pi \times D1 \times L$, where L is a length of the crossbar 300A and D1 is a diameter of the inner liner 84 the combustor 80 at the dilution hole location (shown in FIGS. 2 and 3). The total area A2 of the plurality of crossbars 300A in the combustor 80 is $\pi \times D2 \times L$, where L is a length of the crossbar 300A and D2 is a diameter of the outer liner 82 the combustor 80 at the dilution hole location (shown in FIGS. 2 and 3). The diameter D1 of the inner liner 84 is substantially equal to the diameter D2 of the outer liner 82 as the inner liner 84 is close to the outer liner 82 and both are located at a distance from a center-axis of the combustor 80 greater than a distance separating the inner liner 84 and the outer liner 82. The total dilution area of all dilution holes 400 is equal to $N \times \pi \times d^2/4$, where N is the number of dilution holes, and d is the diameter of a dilution hole 400. Area A3 is equal to a sum of the total dilution area (total area of the dilution holes 400 that is equal to $N \times \pi \times d^2/4$) and the total area of the cooling holes 401. A range of a ratio of the area A3 to the area A1 is between 0.1 and 0.95. Similarly, a range of a ratio of the area A3 to the area A2 is between 0.1 and 0.95 (area A1 is substantially equal to area A2).

Figure 6:
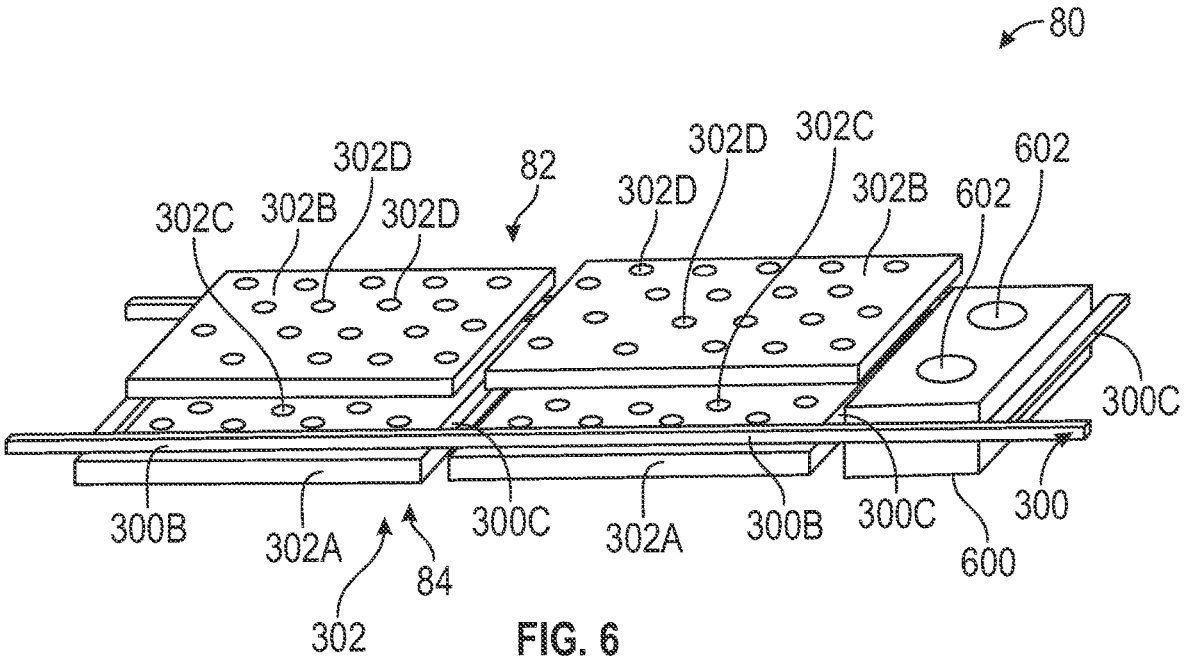
FIG. 6 is a schematic perspective view of a section of the inner liner and the outer liner of the combustor, according to another embodiment of the present disclosure.

FIG. 6 is a schematic perspective view of a section of the inner liner 84 and the outer liner 82 of the combustor 80, according to another embodiment of the present disclosure. As shown in FIG. 6, the plurality of planks 302, which include the plurality of inner planks 302A and the plurality of outer planks 302B, are mounted to the skeleton mesh structure 300. The plurality of inner planks 302A include a plurality of holes 302C. The plurality of outer planks 302B include a plurality of holes 302D. As shown in FIG. 6, the plurality of inner planks 302A are mounted on one side of the skeleton mesh structure 300. The plurality of holes 302C are distributed along a surface of the plurality of the inner planks 302A. The plurality of holes 302D are distributed along a surface of the plurality of the outer planks 302B. The skeleton mesh structure 300 has a plurality of longitudinal bars 300B and a plurality of transverse bars 300C. The plurality of transverse bars 300C are substantially perpendicular to the plurality of longitudinal bars 300B. In addition, the combustor 80 also includes one or more dilution hole planks 600 mounted to the skeleton mesh structure 300. The one or more dilution hole planks 600 are mounted on the longitudinal bars 300B and the plurality of transverse bars 300C of the skeleton mesh structure 300. In this exemplary illustration the plurality of dilution holes 602 are within the dilution hole plank 600, which is then mounted or otherwise coupled to the skeleton mesh structure 300. Various mounting configurations can be used to mount the dilution hole planks 600 on the longitudinal bars 300B and the plurality of transverse bars 300C of the skeleton mesh structure 300. These various configurations will be explained in detailed in the following paragraphs.

The one or more dilution hole planks 600 comprise a plurality of dilution holes 602 that are configured to allow air to pass therethrough into the combustion chamber 88 (shown in FIG. 3) to further mix with the fuel-air mixture. The one or more dilution hole planks 600 having the plurality of dilution holes 602 is referred to generally as the dilution hole structure. In addition, in an embodiment, the one or more dilution hole planks 600 may also have a plurality of cooling holes (not shown in FIG. 6) similar to the cooling holes 401 shown in FIG. 5B.

Figure 7:
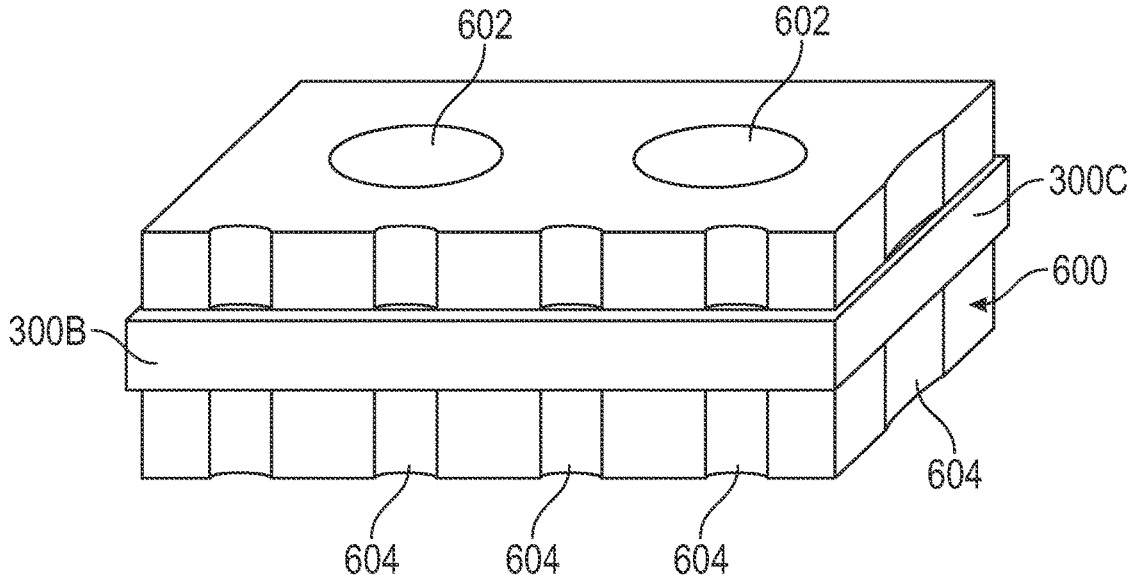
FIG. 7 is a perspective view of one or more dilution hole planks mounted to the skeleton mesh structure showing the plurality of dilution holes and peripheral or edge cooling slots, according to an embodiment of the present disclosure.

FIG. 7 is a perspective view of the one or more dilution hole planks 600 mounted to the skeleton mesh structure 300 showing the plurality of dilution holes 602 and peripheral cooling slots 604, according to an embodiment of the present disclosure. As shown in FIG. 7, in addition to the dilution holes 602, peripheral cooling slots 604 can also be provided in the one or more dilution hole planks 600. The peripheral cooling slots 604 are provided at a periphery of the one or more dilution hole planks 600 at an interface between the one or more dilution hole planks 600, and one of the plurality of transverse bars 300C, and/or one of the plurality of longitudinal bars 300B. Although two dilution holes 602 are depicted in FIG. 7, any number of dilution holes can be provided. The peripheral cooling slots 604 can be used for cooling the one or more dilution hole planks 600. Therefore, these peripheral cooling slots 604 are often called cooling peripheral cooling slots.

Figure 8A:
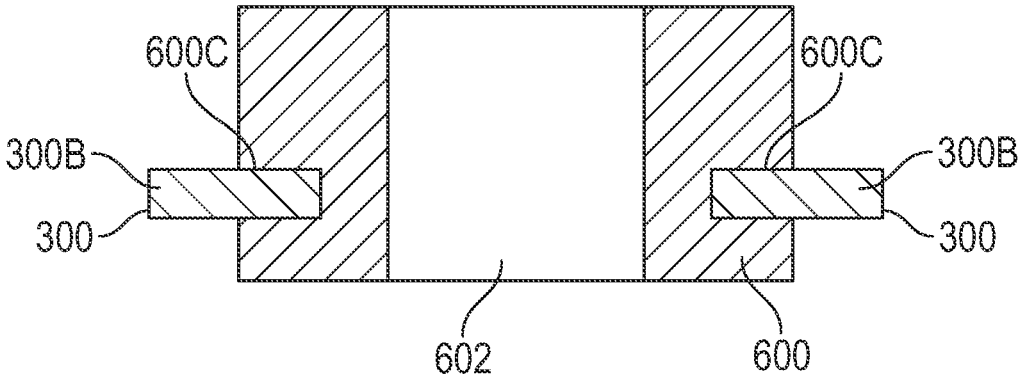
FIGS. 8A and 8B are cross-sectional views of the one or more dilution hole planks mounted to the skeleton mesh structure, according to various embodiments of the present disclosure.
Figure 8B:
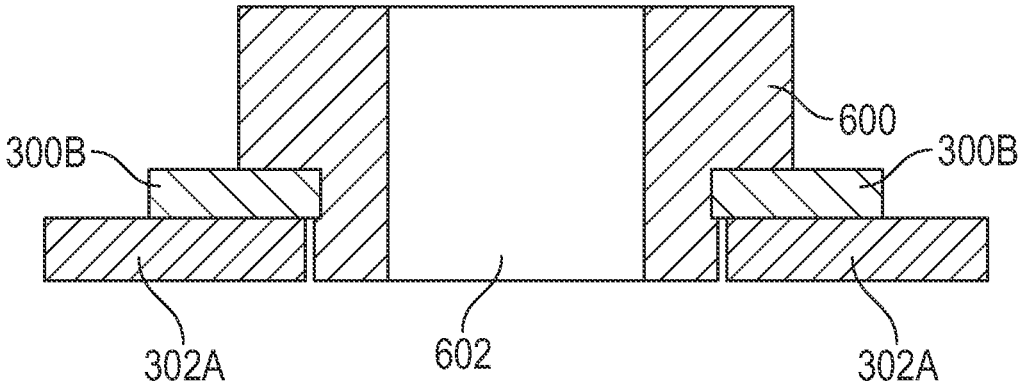

FIGS. 8A and 8B are cross-sectional views of the one or more dilution hole planks 600 mounted to the skeleton mesh structure 300, according to various embodiments of the present disclosure. As shown in FIG. 8A, the one or more dilution hole planks 600 are coupled, for example, to the plurality of longitudinal bars 300B of the skeleton mesh structure 300. In an embodiment, the one or more dilution hole planks 600 can be provided with a plurality of gang channels 600C and the plurality longitudinal bars 300B of the skeleton mesh structure 300 can be inserted in the plurality of gang channels 600C. As shown in FIG. 8B, the one or more dilution hole planks 600 are coupled, for example, to the plurality of longitudinal bars 300B of the skeleton mesh structure 300. However, alternatively, or in addition, the one or more dilution hole planks 600 can also be coupled or mounted to the plurality of transverse bars 300C of the skeleton mesh structure 300. In an embodiment, as shown in FIG. 8B, the plurality of inner planks 302A can be mounted to the plurality longitudinal bars 300B of the skeleton mesh structure 300, or vice versa. The one or more dilution hole planks 600 can be mounted to the plurality of longitudinal bars 300B of the skeleton mesh structure 300. The one or more dilution hole planks 600 can have one or more dilution holes 602. The one or more dilution hole planks 600 can be mounted to the skeleton mesh structure 300 using various types of connections methods including, but not limited to, bolts, pins, clips, brazing, additive, pistons, W-seals, etc. In an embodiment, the dilution hole planks 60 can be coupled to the plurality of longitudinal bars 300B and/or to the transverse 300C using any of a plurality connections method, including, but not limited to, bolts, pins, clips, brazing, welding, additive, spring clips, piston, W-Seals, etc. In an embodiment, the dilution hole plank 600 can be slid in a circumferential gang channel where the gang channels can be provided in a form of brackets (e.g., C-brackets) around a periphery of the dilution hole plank 600.

Figure 9A:
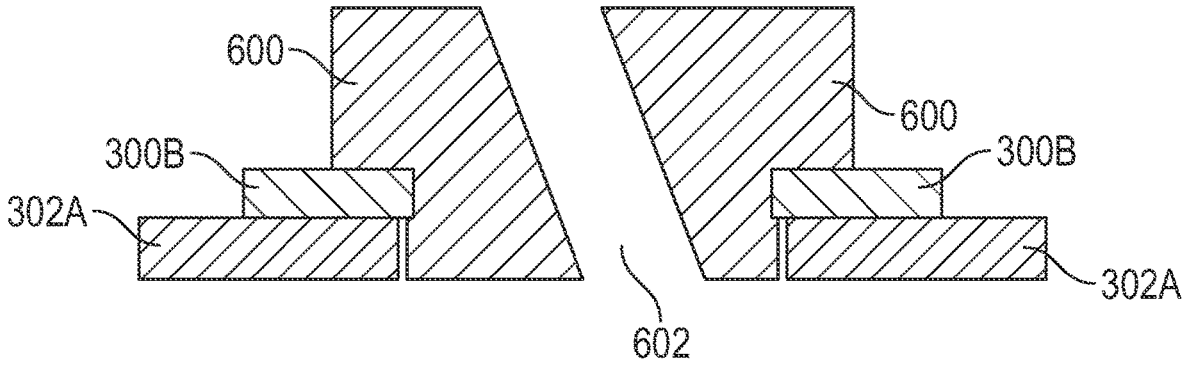
FIG. 9A through 9E are cross-sectional views of the one or more dilution hole planks mounted to the skeleton mesh structure showing various configurations of the one or more dilution holes, according to various embodiments of the present disclosure.
Figure 9B:
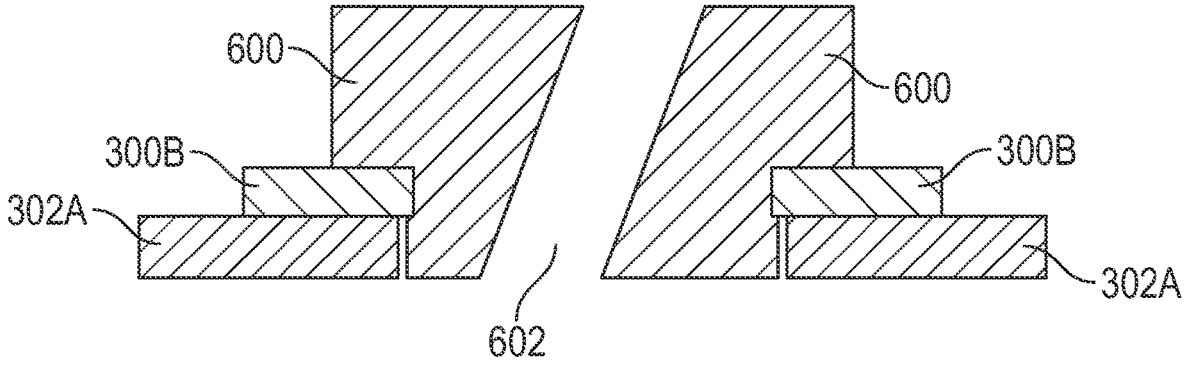
Figure 9C:
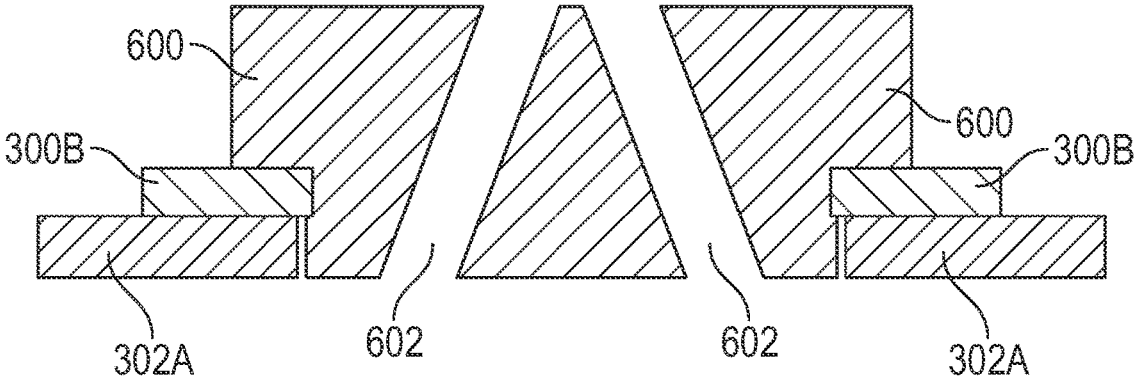
Figure 9D:
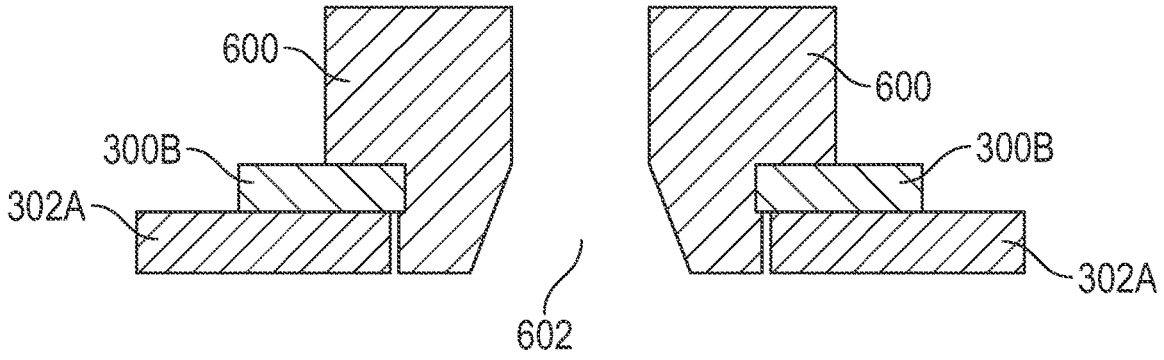
Figure 9E:
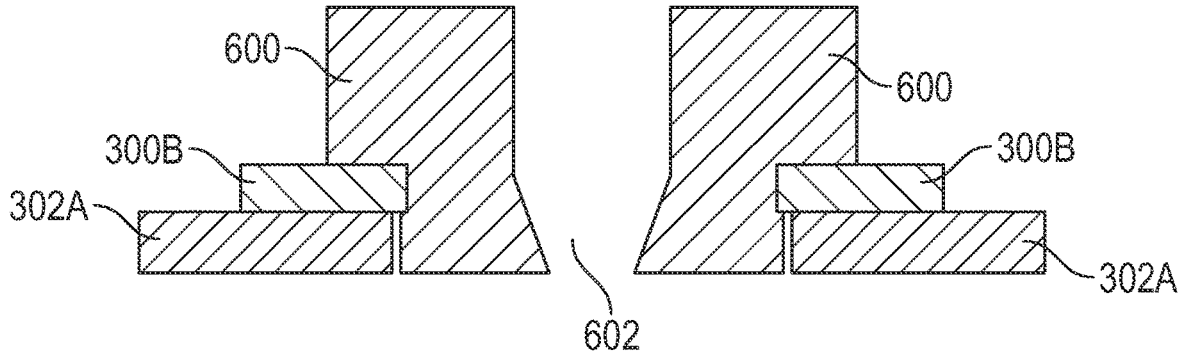

FIG. 9A through 9E are cross-sectional views of the one or more dilution hole planks 600 mounted to the skeleton mesh structure 300 showing various configurations of the one or more dilution holes 602, according to various embodiments of the present disclosure. FIG. 9A shows one or more dilution holes 602 that are aft inclined. FIG. 9B shows one or more dilution holes 602 that are forward inclined. FIG. 9C shows a plurality of dilution holes 602 that are forward and aft inclined. FIG. 9D shows one or more dilution holes 602 that are vertically diverging. FIG. 9E shows one or more dilution holes 602 that are vertical and converging. Any one of the configurations described above can be used in combination with any other one of the above described configurations.

FIGS. 10A to 10E show various geometrical configurations of structural elements of the skeleton mesh structure 300 shown in FIGS. 3, 4, and 6, according to various embodiments of the present disclosure. The skeleton mesh structure 300 can include a plurality of structural elements 306 that connect together to form the skeleton mesh structure 300. As shown in FIGS. 10A to 10E, each of the plurality of structural elements 306 can have any desired geometrical shape, including any polygonal shape such as a square shape or a rectangular shape, a rhombus shape, a triangular shape, a pentagonal shape, a hexagonal shape, or a more complex shape, etc. Each of the structural elements 306 can have a plurality of sides defining a hollow face.

FIGS. 11A to 11E show various geometrical configurations of planks of the plurality of inner planks 302A and the plurality of outer planks 302B, according to various embodiments of the present disclosure. As shown in FIGS. 9A to 9E, each of the plurality of inner planks 302A and the plurality of outer planks 302B can also have a geometrical shape that matches a corresponding shape of each of the plurality of structural elements 306 shown in FIGS. 10A to 10E. Each of the plurality of inner planks 302A and the plurality of outer planks 302B is essentially a filled shape. The filled shape is provided with a plurality of holes 302C. The filled shape (shown in FIGS. 11A to 11E) of each of the plurality of inner planks 302A and each of the plurality of outer planks 302B can be mounted to a corresponding hollow shape (shown in FIGS. 10A to 10E) of the plurality of structural elements 306. The plurality of inner planks 302A and the plurality of outer planks 302B can be mounted to the plurality of structural elements 306 of the skeleton mesh structure 300 using various fastening techniques similar to covering, for example, a truss structure of a bridge, a building, aircraft fuselage, rocket structures, etc.

Figure 12B:
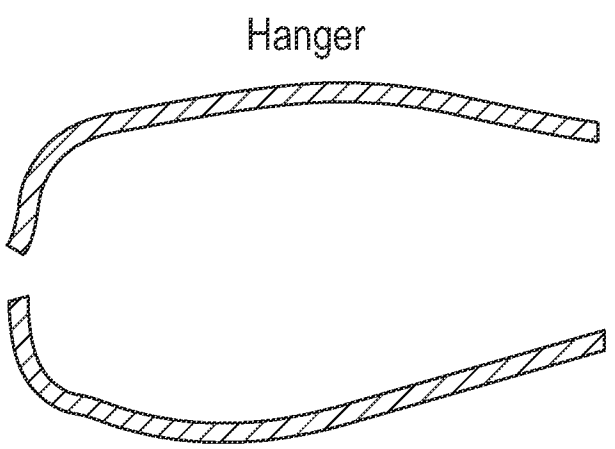
FIGS. 12A and 12B are schematic cross-sectional views of a combustor using the skeleton mesh structure together with the plurality of inner planks, according to an embodiment of the present disclosure.
Figure 12A:
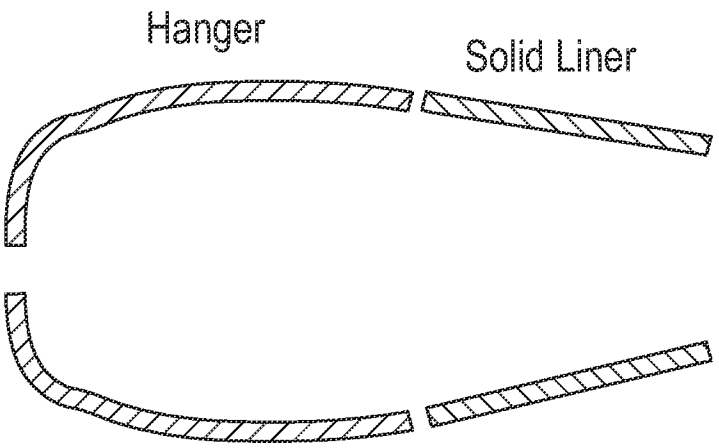

FIGS. 12A and 12B are schematic cross-sectional views of a combustor 80 using the skeleton mesh structure 300 together with the plurality of inner planks 302A, according to an embodiment of the present disclosure. In FIG. 12A, the inner liner 84 and outer liner 82 of the combustor 80 are composed of forward and aft segments of the respective liner. Forward segment can be of hanger type with the plurality of inner planks 302A and the plurality of outer planks 302B (hollow planks) and the aft segment can be from current art solid liner having an annular gap between the two segments. FIG. 12B shows inner liner 84 and outer liner 82 both made from hanger and hollow plank arrangement.

As can be appreciated from the discussion above, a combustor includes a skeleton structure. The combustor also includes at least one liner operably coupled to the skeleton structure to at least partially define a combustion chamber, and a plurality of first planks mounted to a first side of the at least one liner and a plurality of second planks mounted to a second side of the at least one liner. The combustor further includes at least one dilution hole structure provided with a portion of the skeleton structure, and including at least one dilution hole configured to allow fluid to pass therethrough into the combustion chamber.

The combustor according to the previous clause, the dilution hole structure including a crossbar of the skeleton mesh structure, the crossbar having the plurality of dilution holes.

The combustor according to any of the previous clauses, the skeleton mesh structure including a plurality of longitudinal bars and a plurality of transverse bars, and the plurality of first planks and the plurality of second planks being mounted to the plurality of longitudinal bars and the plurality of transverse bars.

The combustor according to any of the previous clauses, the dilution hole structure including one or more dilution hole planks having the plurality of dilution holes and a plurality of cooling holes.

The combustor according to any of the previous clauses, the one or more dilution hole planks being mounted to the skeleton mesh structure.

The combustor according to any of the previous clauses, the skeleton mesh structure including a plurality of longitudinal bars and a plurality of transverse bars, and the one or more dilution hole planks being mounted to the plurality of longitudinal bars and the plurality of transverse bars.

The combustor according to any of the previous clauses, the one or more dilution hole planks including a plurality of gang channels and the plurality of longitudinal bars, or the plurality of transverse bars, or both, being inserted in the plurality of gang channels of the one or more dilution planks.

The combustor according to any of the previous clauses, the one or more dilution hole planks being mounted to the plurality of longitudinal bars or the plurality of transverse bars or both.

The combustor according to any of the previous clauses, the one or more dilution hole planks further including a plurality of peripheral cooling slots provided at a periphery of the one or more dilution hole planks at an interface between the one or more dilution hole planks and the skeleton mesh structure.

The combustor according to any of the previous clauses, the plurality of dilution holes being vertical, aft inclined, or forward inclined, or any combination thereof.

The combustor according to any of the previous clauses, the plurality of dilution holes being converging holes, or diverging holes, or both.

The combustor according to any of the previous clauses, the plurality of first planks and the plurality of second planks including a plurality of holes to pass air therethrough to cool down the plurality of first planks.

The combustor according to any of the previous clauses, the plurality of structural elements having a hollow polygonal shape with a plurality of sides defining a hollow face.

The combustor according to any of the previous clauses, the plurality of first planks or the plurality of second planks, or both, having a filled polygonal shape that matches the hollow polygonal shape of the plurality of structural elements.

Another aspect of the present disclosure is to provide a turbine engine including a combustor. The combustor includes a skeleton structure. The combustor also includes at least one liner operably coupled to the skeleton structure to at least partially define a combustion chamber, and a plurality of first planks mounted to a first side of the at least one liner and a plurality of second planks mounted to a second side of the at least one liner. The combustor further includes at least one dilution hole structure provided with a portion of the skeleton structure, and including at least one dilution hole configured to allow fluid to pass therethrough into the combustion chamber.

The turbine engine according to the previous clause, the dilution hole structure including a crossbar of the skeleton mesh structure, the crossbar having the plurality of dilution holes.

The turbine engine according to any of the previous clauses, the skeleton mesh structure including a plurality of longitudinal bars and a plurality of transverse bars, and the plurality of first planks and the plurality of second planks being mounted to the plurality of longitudinal bars and the plurality of transverse bars.

The turbine engine according to any of the previous clauses, the dilution hole structure including a one or more dilution planks having the plurality of dilution holes and a plurality of cooling holes.

The combustor according to any of the previous clauses, the one or more dilution planks further including a plurality of peripheral cooling slots provided at a periphery of the one or more dilution hole planks at an interface between the one or more dilution hole planks and the skeleton mesh structure.

The turbine engine according to any of the previous clauses, the one or more dilution planks being mounted to the skeleton mesh structure.

Although the foregoing description is directed to the preferred embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A combustor comprising:

a skeleton mesh structure;

at least one liner operably coupled to the skeleton mesh structure to at least partially define a combustion chamber, and comprising a plurality of first planks mounted to a first side of the at least one liner and a plurality of second planks mounted to a second side of the at least one liner; and at least one dilution hole structure adjacent at least one of the plurality of first planks and at least one of the plurality of second planks and including at least one dilution hole configured to allow fluid to pass therethrough into the combustion chamber, wherein the at least one dilution hole structure is at least one of:

(i) mounted to the skeleton mesh structure, the at least one dilution hole structure having a radial thickness greater than a radial thickness of the skeleton mesh structure, a radial thickness of the at least one of the plurality of first planks, and a radial thickness of the at least one of the plurality of second planks; or (ii) a portion of the skeleton mesh structure, the at least one dilution hole structure having a radial thickness greater than a radial thickness of a remainder of the skeleton mesh structure, a radial thickness of the at least one of the plurality of first planks, and a radial thickness of the at least one of the plurality of second planks.

2. The combustor according to claim 1, wherein the at least one dilution hole structure is the portion of the skeleton mesh structure and comprises a crossbar of the skeleton mesh structure, the at least one dilution hole comprising a plurality of dilution holes.

3. The combustor according to claim 1, wherein the skeleton mesh structure comprises a plurality of longitudinal bars and a plurality of transverse bars, and the plurality of first planks and the plurality of second planks are mounted to the plurality of longitudinal bars and the plurality of transverse bars.

4. The combustor according to claim 1, wherein the at least one dilution hole comprises a plurality of dilution holes, the plurality of dilution holes being vertical, aft inclined, or forward inclined, or any combination thereof.

5. The combustor according to claim 1, wherein the at least one dilution hole comprises a plurality of dilution holes, the plurality of dilution holes comprising converging holes, or diverging holes, or both.

6. The combustor according to claim 1, wherein the plurality of first planks and the plurality of second planks comprise a plurality of cooling holes to pass air therethrough to cool down the plurality of first planks.

7. The combustor according to claim 1, wherein the at least one dilution hole structure is mounted to the skeleton mesh structure and comprises one or more dilution hole planks, the at least one dilution hole comprising a plurality of dilution holes, the one or more dilution hole planks further comprising a plurality of cooling holes.

8. The combustor according to claim 7, wherein the one or more dilution hole planks further comprise a plurality of peripheral cooling slots provided at a periphery of the one or more dilution hole planks at an interface between the one or more dilution hole planks and the skeleton mesh structure.

9. The combustor according to claim 7, wherein the one or more dilution hole planks comprise a plurality of gang channels and the one or more dilution hole planks are mounted to the skeleton mesh structure using the plurality of gang channels.

10. The combustor according to claim 7, wherein the skeleton mesh structure comprises a plurality of longitudinal bars and a plurality of transverse bars, and the one or more dilution hole planks are mounted to the plurality of longitudinal bars or the plurality of transverse bars, or both the plurality of longitudinal bars and the plurality of transverse bars.

11. The combustor according to claim 10, wherein the one or more dilution hole planks comprise a plurality of gang channels, and the plurality of longitudinal bars or the plurality of transverse bars, or both the plurality of longitudinal bars and the plurality of transverse bars, are inserted in the plurality of gang channels of the one or more dilution hole planks.

12. The combustor according to claim 10, wherein the one or more dilution hole planks are mounted to the plurality of longitudinal bars, or the plurality of transverse bars, or both the plurality of longitudinal bars and the plurality of transverse bars, using bolts, pins, clips, brazing, welding, additive, pistons, W-seals, or any combination thereof.

13. The combustor according to claim 1, wherein the skeleton mesh structure comprises a plurality of structural elements, the plurality of structural elements having a hollow polygonal shape with a plurality of sides defining a hollow face.

14. The combustor according to claim 13, wherein the plurality of first planks, or the plurality of second planks, or both the plurality of first planks and the plurality of second planks, have a filled polygonal shape that matches the hollow polygonal shape of the plurality of structural elements.

15. A turbine engine comprising:

a combustor comprising:

(a) a skeleton mesh structure;

(b) at least one liner operably coupled to the skeleton mesh structure to at least partially define a combustion chamber, and comprising a plurality of first planks mounted to a first side of the at least one liner and a plurality of second planks mounted to a second side of the at least one liner; and (c) at least one dilution hole structure provided with a portion of the skeleton mesh structure adjacent at least one of the plurality of first planks and at least one of the plurality of second planks, and including at least one dilution hole configured to allow fluid to pass therethrough into the combustion chamber, wherein the at least one dilution hole structure is at least one of:

(i) mounted to the skeleton mesh structure, the at least one dilution hole structure having a radial thickness greater than a radial thickness of the skeleton mesh structure, a radial thickness of the at least one of the plurality of first planks, and a radial thickness of the at least one of the plurality of second planks; or (ii) a portion of the skeleton mesh structure, the at least one dilution hole structure having a radial thickness greater than a radial thickness of a remainder of the skeleton mesh structure, a radial thickness of the at least one of the plurality of first planks, and a radial thickness of the at least one of the plurality of second planks.

16. The turbine engine according to claim 15, wherein the at least one dilution hole structure is the portion of the skeleton mesh structure and comprises a crossbar of the skeleton mesh structure, the at least one dilution hole comprising a plurality of dilution holes.

17. The turbine engine according to claim 15, wherein the skeleton mesh structure comprises a plurality of longitudinal bars and a plurality of transverse bars, and the plurality of first planks and the plurality of second planks are mounted to the plurality of longitudinal bars and the plurality of transverse bars.

18. The turbine engine according to claim 15, wherein the at least one dilution hole structure is mounted to the skeleton mesh structure and comprises one or more dilution hole planks, the at least one dilution hole comprising a plurality of dilution holes, the one or more dilution hole planks further comprising a plurality of cooling holes.

19. The turbine engine according to claim 18, wherein the one or more dilution hole planks further comprise a plurality of peripheral cooling slots provided at a periphery of the one or more dilution hole planks at an interface between the one or more dilution hole planks and the skeleton mesh structure.

20. The turbine engine according to claim 18, wherein the skeleton mesh structure comprises a plurality of longitudinal bars and a plurality of transverse bars, and the one or more dilution hole planks are mounted to the plurality of longitudinal bars or the plurality of transverse bars, or both the plurality of longitudinal bars and the plurality of transverse bars.

* * * * *